US005697643A

United States Patent [19]

Marasco et al.

[11] Patent Number: 5,697,643

[45] Date of Patent: Dec. 16, 1997

[54] WALKER ATTACHMENT FOR IN-LINE SKATE

[76] Inventors: Vincent Marasco; Edward Mazzarino, both of 4339 Allott Ave., Sherman Oaks, Calif. 91423

[21] Appl. No.: 591,972

[22] Filed: Jan. 29, 1996

Related U.S. Application Data

[63] Continuation-in-part of Ser. No. 37,032, Apr. 3, 1995, Pat. No. Des. 372,948.

[51] Int. Cl.[6] ..... A63C 3/00

[52] U.S. Cl. ..... 280/825; 280/811

[58] Field of Search ..... 280/7.1, 7.13, 280/10, 11.2, 809, 811, 825

[56] References Cited

U.S. PATENT DOCUMENTS

| | | | |
|---|---|---|---|
| 2,035,897 | 3/1936 | Kosanovich | 280/7.13 |
| 3,292,940 | 12/1966 | Weitzner | 280/7.13 |
| 5,197,572 | 3/1993 | Roberts | 280/11.2 |
| 5,236,224 | 8/1993 | Anderson et al. | 280/825 |
| 5,531,462 | 7/1996 | Gu | 280/7.13 |

FOREIGN PATENT DOCUMENTS

| | | | |
|---|---|---|---|
| 309567 | 3/1918 | Germany | 280/7.1 |
| 400873 | 4/1966 | Switzerland | 280/825 |

*Primary Examiner*—Brian L. Johnson
*Assistant Examiner*—Frank Vanaman
*Attorney, Agent, or Firm*—Donald Diamond

[57] ABSTRACT

An in-line skate with an attached walker that is pivotable securely downward to interpose a flat walking surface between the skate wheels and ground, and pivotable securely upward away from the wheels and skate undercarriage so as not to interfere with skating. The walker includes a first flange bolted to the undercarriage and hingeably connected to an angle member having a second flange integral with a third flange to which is attached a walking sole. In a first embodiment the sole is attached to an angle member third flange by a plurality of rivets. In a second embodiment the sole is adhesively attached to the angle member third flange.

12 Claims, 3 Drawing Sheets

WALKER ATTACHMENT FOR IN-LINE SKATE

CROSS-REFERENCE TO RELATED APPLICATION

This application is a continuation-in-part of U.S. design application Ser. No. 29/037,032, filed Apr. 3, 1995 now U.S. Pat. No. 0,372,948 and entitled "In-Line Skate With Walking Sole."

BACKGROUND OF THE INVENTION

1. Field Of The Invention

The invention relates to accessories for in-line roller skates and, more particularly, to a device attached to a skate which includes a walking sole pivotable upward and securely away from the skate assembly undercarriage while a person is skating, and pivotable downward to enclose the wheels thereby creating a planar walking surface.

2. Description Of The Related Art

In recent times, the roller skating public increasingly has come to prefer in-line-type skates over skates having tandem wheels. In-line skates are available under various brand names as, for example, ROLLERBLADE which is a trademark of Rollerblade, Inc. of Minnetonka, Minn., and are characterized by a shoe portion attached to a skate assembly portion having three or more linearly-aligned wheels centrally located beneath the shoe. The skate assembly portion typically includes a rigid undercarriage riveted or otherwise rigidly fastened to the bottom portion of the shoe portion. The wheels are usually adjustably secured to the undercarriage.

In-line roller skates are extremely unstable when a person wearing such skates attempts to walk on an uneven or irregular surface. For example, going up or down stairs may be dangerous if not infeasible, unless a handrail can be continuously gripped, since the skates may uncontrollably roll on and over the stair treads. Uncontrolled rolling may also occur when skates are worn while attempting to traverse a slippery or sand-covered surface. In-line skates can also mar and even permanently damage floor surfaces such as linoleum, due to the high pressure exerted by the small contact area of each wheel.

U.S. Pat. No. 3,861,697 to Dolce, U.S. Pat. No. 4,413,842 to Loredo, and U.S. Pat. No. 4,364,187 to Melendez et al. disclose walking devices that are removably secured to the bottom of a tandem wheel-type roller skate. U.S. Pat. No. 5,236,224 to Anderson et al. is directed to a removable walking device suitable for an in-line skate. The invention is a wheel cover including a front receptacle adapted to inwardly receive a skate's front wheel, a rear receptacle adapted to inwardly receive the skate's rear wheel, and a pair of flexible, resilient straps connecting the two receptacles. Although such covers are easily applied and removed, much as a rain "rubber" is slipped on over a shoe and subsequently peeled off, they require that a user carry a pair of the covers while skating. Many people are likely to find this inconvenient if not objectionable, particularly during the summer months when skaters often prefer to wear a minimum of clothing. Thus there is a need for a walking device which does not have to be removed from a skate yet does not interfere with skating.

OBJECTS OF THE INVENTION

Accordingly, it is an object of the present invention to provide a device including a walking sole which can be permanently or semi-permanently attached to an in-line skate.

Another object of the invention is to provide a non-removable sole which when not in its walking position is unobtrusive and does not interfere with skating.

A further object of the invention is to provide a device that is simple, reliable and easy to use.

Yet another object of the invention is to provide a device that is simple and inexpensive to manufacture.

Other objects of the invention will become evident when the following description is considered with the accompanying drawings.

SUMMARY OF THE INVENTION

These and other objects of the invention are achieved by providing a walker device adapted for attachment to the undercarriage of an in-line skate. The walker includes a generally planar (first) flange rigidly attached to the undercarriage by the wheel axles of the undercarriage, each axle passing through an elongated hole in the flange and a corresponding hole in the undercarriage. The flange holes are generally collinear, enabling longitudinal adjustment of the walker to achieve a best fit of the walking sole over the wheels. The flange is pivotally connected by means of a hinge to a generally planar (second) flange of an angle member, with the other part of the angle member being determined by a (third) flange that includes a generally planar middle portion disposed between arcuate front and rear end portions.

In a first embodiment, a walking sole including a generally planar middle portion having a plurality of rubber snap-in rivets and disposed between arcuate front and rear end portions is rigidly attached to the third flange by the rivets. The third flange front and rear end portions are closely received, respectively, within a pocket in the upper surface of the walking sole front and rear end portions.

In a second embodiment, a walking sole including a generally planar middle portion disposed between arcuate front and rear portions shaped to conform, respectively, to the front and rear end portions of the third flange, is adhesively attached to the third flange.

A user wishing to begin or resume skating pivots the angle member of the walker attached to each of his or her skates upwardly about the hinge to an "UP" storage position wherein the first and second flanges are generally juxtaposed, so that the walking sole is positioned away from and cannot interfere with the wheels. A spring connected between the front end portion of the walking sole and the shoe toe maintains the angle member in the UP position. When the user wishes to begin walking, the angle member is pivoted downwardly about the hinge about 180 degrees to a "DOWN" position wherein the first and second flanges are generally coplanar, so that the walking sole is positioned over the wheels, thus providing a flat walking surface. The spring maintains the angle member in the DOWN position.

A more complete understanding of the present invention and other objects, aspects and advantages thereof will be gained from a consideration of the following description of the preferred embodiment read in conjunction with the accompanying drawings provided herein.

DESCRIPTION OF THE PREFERRED EMBODIMENTS

Figure 1:
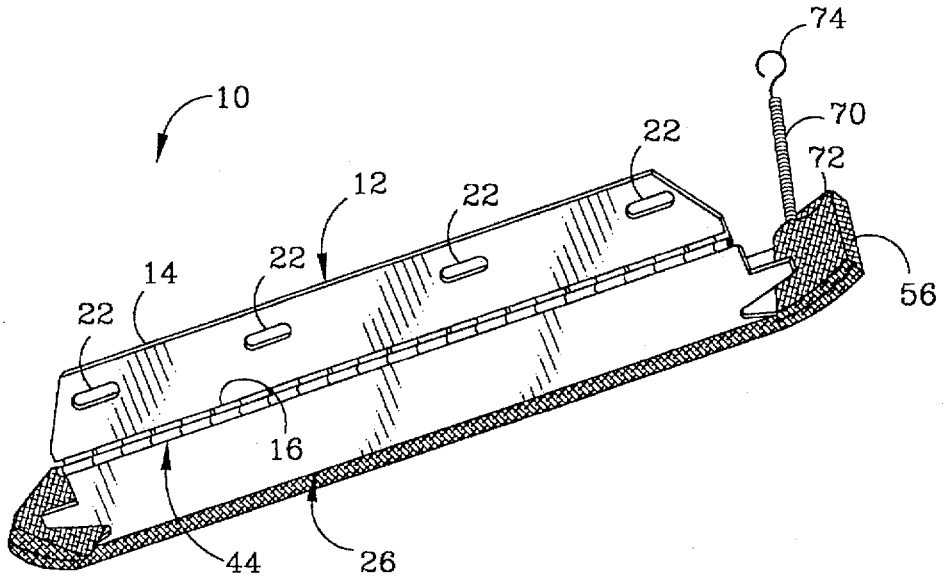
FIG. 1 is an outboard perspective view of a first preferred embodiment of a walker attachment for in-line skates according to the present invention, when the walker is in the walking position.

While the present invention is open to various modifications and alternative constructions, the preferred embodiments shown in the drawings will be described herein in detail. It is to be understood, however, there is no intention to limit the invention to the particular forms disclosed. On the contrary, it is intended that the invention cover all modifications, equivalences and alternative constructions falling within the spirit and scope of the invention as expressed in the appended claims.

Where used here, the word "attached" means that the two parts referred to (e.g., a flange and a walking sole), of aluminum and/or rubber material, and/or plastic material, are riveted or adhesively attached as these forms of attachment are preferred. However, other forms of attachment, such as forming two parts as a unitary structure by a process such as injection molding, may be suitable, consistent with minimizing weight and expense. Where used here, the word "connected" means that the two parts referred to (e.g., two flanges) are either bolted or hinged together.

Figure 2:
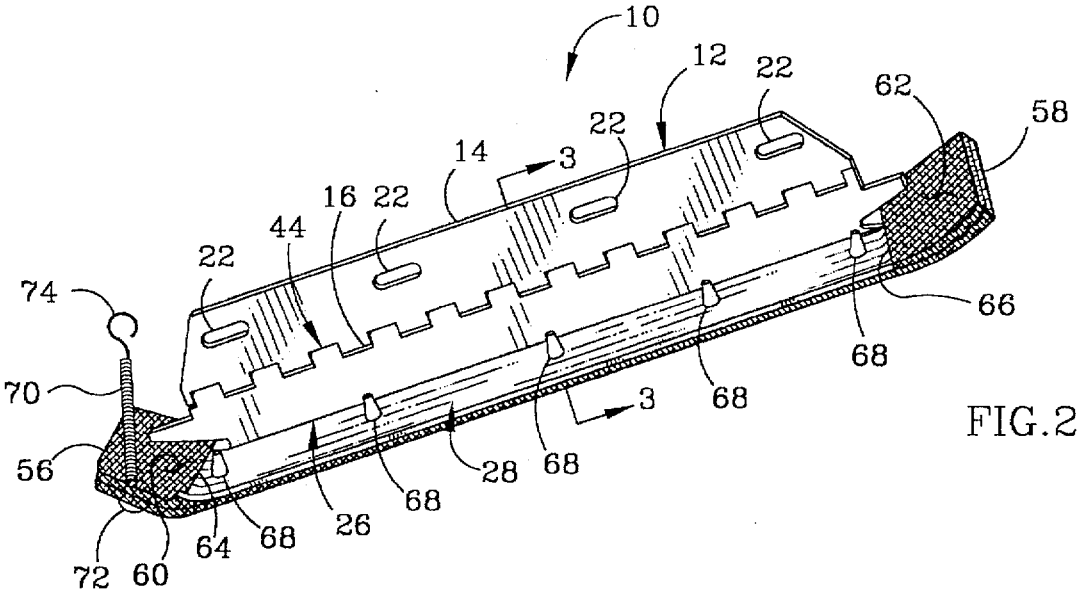
FIG. 2 is an inboard perspective view of the FIG. 1 walker.
Figure 3A:
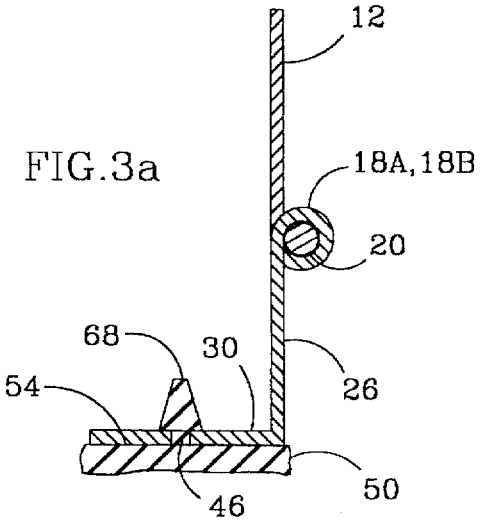
FIG. 3*a* is a cross-sectional view taken along the line 3—3 of FIG. 2.
Figure 4:
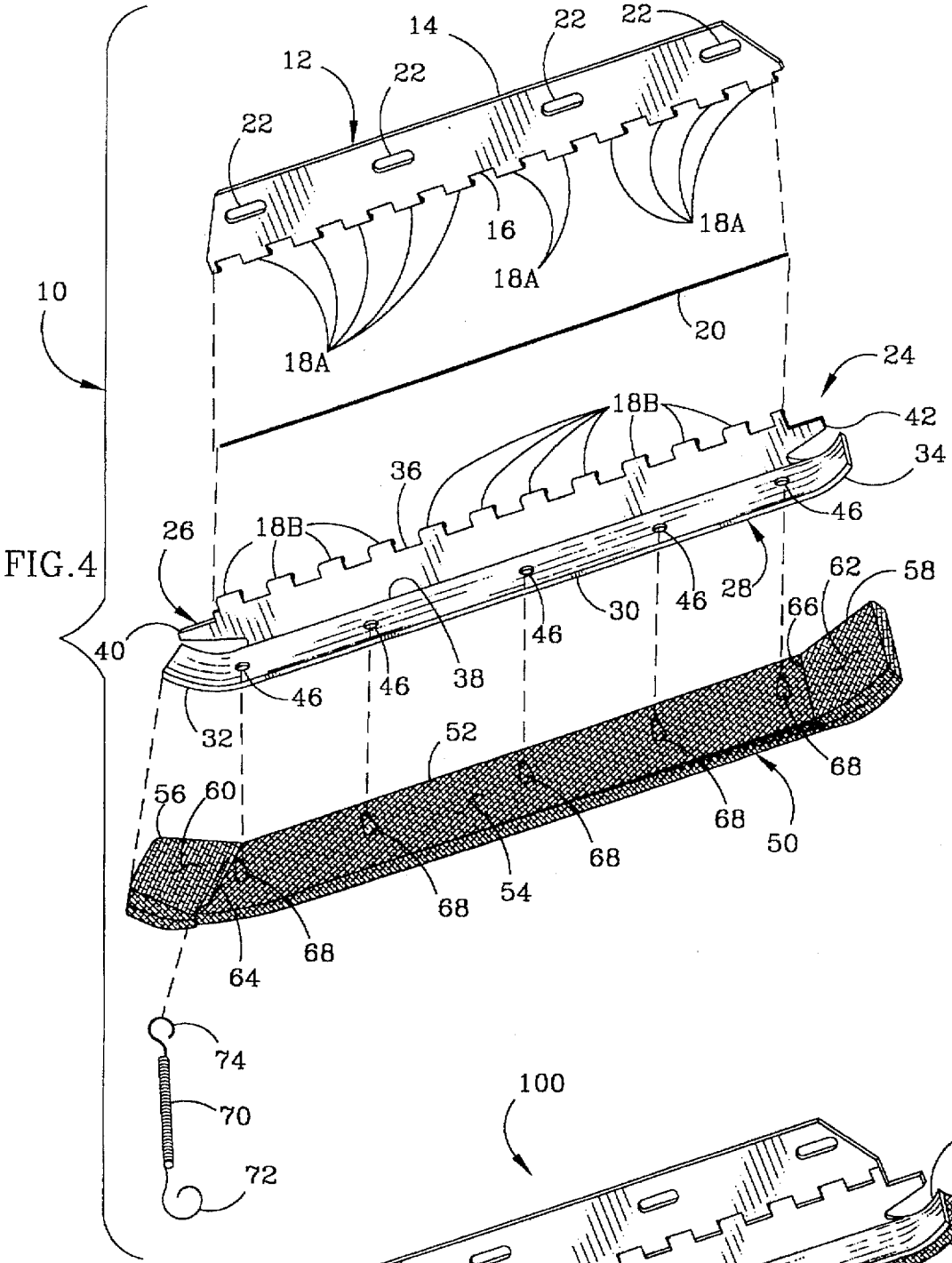
FIG. 4 is an exploded perspective view of the FIGS. 1, 2 walker.

Referring to FIGS. 1, 2 and 4, a first preferred embodiment of a walker 10 includes a generally planar (first) flange 12 having generally parallel upper and lower edges 14 and 16, the edge 16 including a multiplicity of evenly spaced, generally cylindrical receptacles 18A adapted to closely receive a hinge-pin 20 (as shown in FIG. 3*a*). Flange 12 has therethrough a plurality of generally collinear elongated holes 22. As best shown in FIG. 4, the walker 10 further includes an angle member 24 including a generally planar (second) flange 26 generally orthogonal to a (third) flange 28 including a generally planar middle portion 30 disposed between arcuate front and rear end portions 32 and 34. Flange 26 has generally parallel upper and lower edges 36 and 38 and opposed elongated trapezoid-shaped ends 40 and 42. Edge 36 includes a multiplicity of evenly spaced, generally cylindrical receptacles 18B adapted to align and mate with the receptacles 18A and closely receive hinge-pin 20, thereby forming a hinge 44. As best shown in FIG. 4, the middle portion 30 of flange 28 has therethrough a plurality of generally collinear holes 46. As also best shown in FIG. 4, the walker 10 further includes a walking sole 50 having a generally planar middle portion 52 with an upper surface 54 disposed between arcuate front end and rear end portions 56 and 58 having (see also FIG. 2) an upper surface 60 and 62, respectively, including a slotted pocket 64 and 66, respectively. End portions 56 and 58 are shaped to conform with end portions 32 and 34, respectively. Extending upward from surface 54 are a plurality of generally collinear snap-in rivets 68 spaced so as to mate with holes 46 (see FIGS 3*a* and 4) when sole 50 is pressed against flange 28 after end portions 32 and 34 are inserted within pockets 64 and 66, respectively. As shown in FIGS. 1, 2 and 4, a spring 70 including opposed hooks 72 and 74 is connected via hook 72 to the walking sole front end portion 56.

Figure 3B:
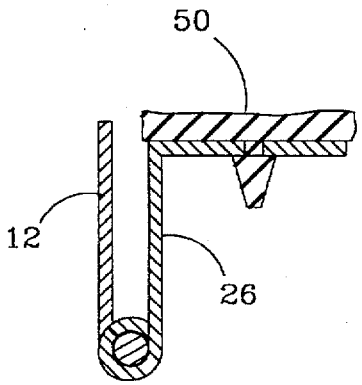
FIG. 3*b* is a cross-sectional view, similar to FIG. 3*a*, when the walker is in the storage position.
Figure 5:
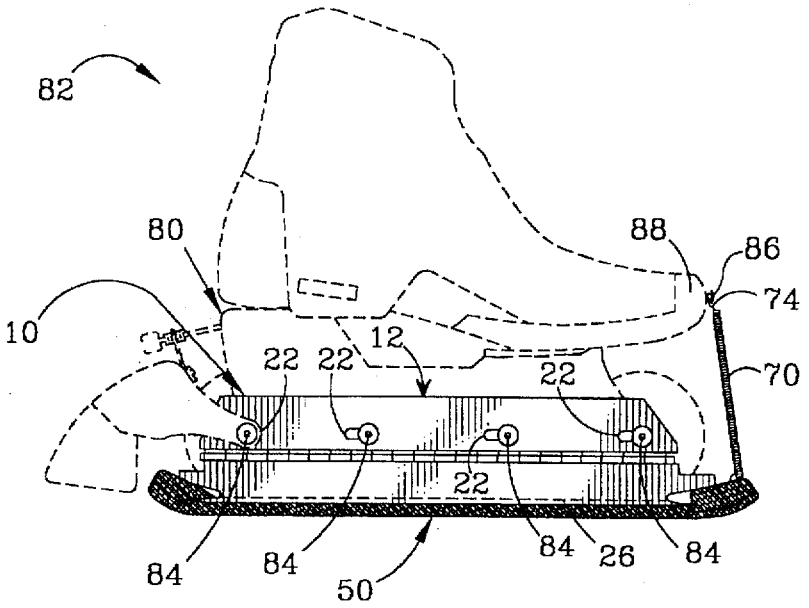
FIG. 5 is an outboard elevational view of the FIGS. 1, 2 walker attached to an in-line skate when the walker is in the walking position.
Figure 6:
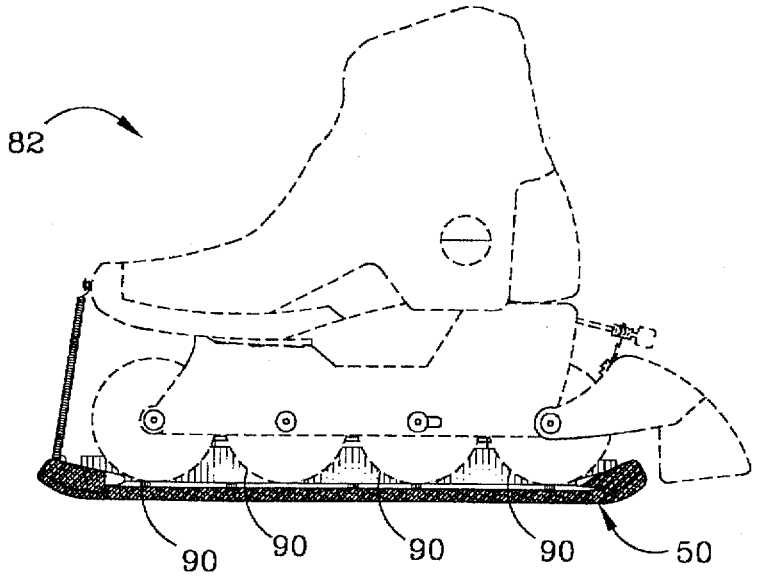
FIG. 6 is an inboard elevational view of the FIG. 5 walker and skate when the walker is in the walking position.
Figure 7:
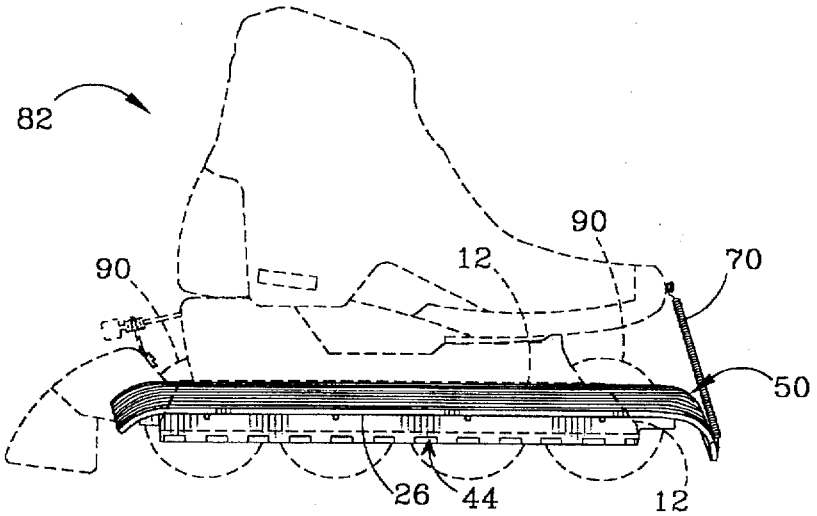
FIG. 7 is an outboard perspective view of the FIG. 5 walker and skate when the walker is in the storage position.

Referring to FIG. 5, the walker 10 is rigidly attached to undercarriage 80 of in-line skate 82 by a plurality of wheel axle bolts 84, one each through the holes 22 in flange 12. Each wheel axle comprises a pair of cooperating bolts 84, with the shank of one bolt being hollow and internally threaded to matingly connect with the external threads of bolt 84. Hook 74 of spring 70 is connected at an eyelet 86 attached to toe portion 88. In FIG. 5, the flanges 12 and 26 are generally coplanar so that sole 50, as best shown in FIG. 6, is disposed generally orthogonal to the wheels 90, thus presenting a flat surface for walking. The tension in spring 70 maintains sole 50 in the walking position. FIG. 7 shows the storage position wherein sole 50 is pivoted outward and upward about 180 degrees about hinge 44 so that the sole cannot interfere with the wheels 90. As shown in FIG. 3*b*, flanges 12 and 26 are generally juxtaposed and sole 50 is generally orthogonal to both flanges. The tension in spring 70 maintains sole 50 in the storage position.

Preferably, the flange 12 and angle member 24 are fabricated from an aluminum alloy or high strength plastic, and the walking sole 50 and rivets 68 are fabricated from a hard rubber material.

Figure 8:
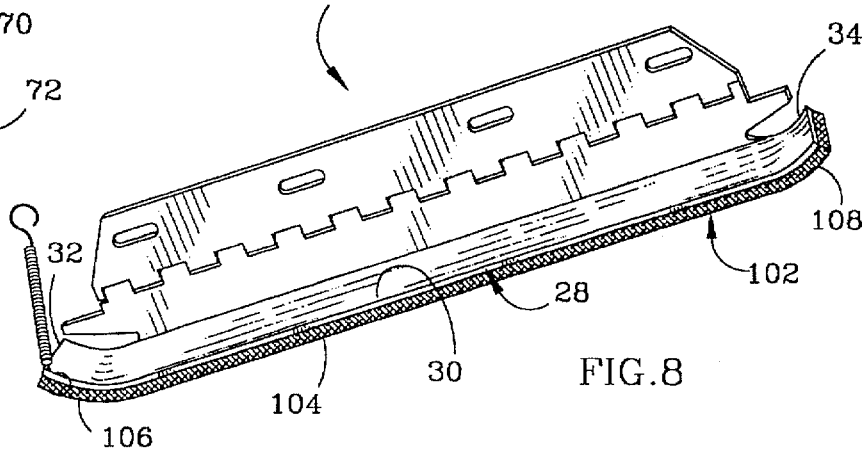
FIG. 8 is an inboard perspective view of a second embodiment of a walker attachment.

Referring to FIG. 8, a second preferred embodiment of a walker 100 is identical to walker 10 except that a walking sole 102 having a generally planar middle portion 104 disposed between arcuate front end and rear end portions 106 and 108 is shaped so that portions 104, 106 and 108 conform closely, respectively, to portions 30, 32 and 34 of flange 28. Sole 102 does not include pockets or rivets. Instead of being attached with rivets, sole 102 is adhesively attached to flange 28.

What is claimed is:

1. A walker device adapted for attachment to an in-line skate including a shoe portion and a skate assembly portion having a plurality of in-line wheels, comprising:

a generally planar first flange rigidly connectable to the skate assembly;

an angle member having a generally planar second flange having opposed upper and lower edges, said second flange at the lower edge attached and generally orthogonal to a third flange having a generally planar middle portion having opposed upper and lower surfaces, the middle portion disposed between front and rear end portions, said second flange at the upper edge pivotally connected to said first flange; said third flange extending the length of said in-line skate whereby the upper surface of said third flange is engageable with the lower surface of said in-line wheels; and a walking sole rigidly attached to the lower surface of the third flange.

2. The walker of claim 1, further comprising:

means for maintaining the angle member in a first position wherein said first and second flanges are generally juxtaposed;

means for maintaining the angle member in a second position wherein said first and second flanges are generally coplanar; and means for pivoting the angle member from said first position to said second position, or from said second position to said first position, said means for pivoting the angle member comprising a hinge connecting said first and second flanges.

3. The walker of claim 2, wherein said means for maintaining the angle member in said first or second position comprises a spring for connecting the walking sole to a predetermined portion of the skate shoe.

4. The walker of claim 3, wherein said skate shoe includes a shoe toe and said predetermined portion of the skate shoe is the shoe toe.

5. The walker of claim 4, wherein the walking sole is attached to said third flange by a plurality of rivets.

6. The walker of claim 4, wherein the walking sole is attached to said third flange by an adhesive.

7. A walker device adapted for attachment to an in-line skate including a shoe portion having a toe portion, and a skate assembly portion including an undercarriage, the walker comprising;

a generally planar first flange having a first plurality of generally collinear elongated holes therethrough, the first flange rigidly connectable to and longitudinally adjustable with respect to the skate assembly undercarriage by a plurality of bolts, one bolt through each hole, the first flange having generally parallel upper and lower edges, the lower edge including a first multiplicity of generally collinear receptacles adapted to closely receive a hinge-pin;

an angle member having a generally planar second flange having opposed upper and lower edges and opposed elongated trapezoid-shaped ends, the upper edge including a second multiplicity of generally collinear receptacles adapted to closely receive a hinge-pin and disposed so as to align and mate with said first multiplicity of receptacles, said second flange at the lower edge integrally attached and generally orthogonal to a third flange having a generally planar middle portion having opposed upper and lower surfaces and a second plurality of holes therethrough, said middle portion disposed between arcuate front and rear end portions;

a hinge-pin through said first and second aligned multiplicities of receptacles;

a walking sole including a generally planar middle portion having an upper surface including a plurality of rivets, said middle portion disposed between arcuate front and rear end portions each having an upper surface including a pocket, the walking sole rigidly attached to said third flange by said rivets through said second plurality of holes, one rivet per hole, the third flange front and rear end portions closely received, respectively, within the pockets of the walking sole front and rear end portions; and a spring for connecting the front end portion of the walking sole to the toe portion of the in-line skate.

8. The walker of claim 7, wherein said first flange and the angle member are fabricated from a lightweight metallic alloy or high strength plastic.

9. The walker of claim 8, wherein the walking sole and rivets are fabricated from a hard rubber material or high strength plastic.

10. A walker device adapted for attachment to an in-line skate including a shoe portion having a toe portion, and a skate assembly portion including an undercarriage, the walker comprising;

a generally planar first flange having a first plurality of generally collinear elongated holes therethrough, the first flange rigidly connectable to and longitudinally adjustable with respect to the skate assembly undercarriage by a plurality of bolts, one bolt through each hole, the first flange having generally parallel upper and lower edges, the lower edge including a first multiplicity of generally collinear receptacles adapted to closely receive a hinge-pin;

an angle member having a generally planar second flange having opposed upper and lower edges and opposed elongated trapezoid-shaped ends, the upper edge including a second multiplicity of generally collinear receptacles adapted to closely receive a hinge-pin and disposed so as to align and mate with said first multiplicity of receptacles, said second flange at the lower edge integrally attached and generally orthogonal to a third flange having a generally planar middle portion having opposed upper and lower surfaces, said middle portion disposed between arcuate front and rear end portions, each end portion having a lower surface;

a hinge-pin through said first and second aligned multiplicities of receptacles;

a walking sole including a generally planar middle portion having an upper surface, said middle portion disposed between arcuate front and rear end portions, each end portion having an upper surface, the upper surfaces of the front end, middle, and rear end portions of the walking sole adhesively attached, respectively, to the lower surfaces of the front end, middle, and rear end portions of said third flange; and a spring for connecting the front end portion of the walking sole to the toe portion of the in-line skate.

11. The walker of claim 10, wherein said first flange and the angle member are fabricated from a lightweight metallic alloy or high strength plastic.

12. The walker of claim 11, wherein the walking sole is fabricated from a hard rubber material or high strength plastic.

* * * * *